US006837085B2

(12) United States Patent
Berthelet et al.

(10) Patent No.: US 6,837,085 B2
(45) Date of Patent: Jan. 4, 2005

(54) TRANSVERSE ULTRASOUND PEENING OF BLADES ON A ROTOR

(75) Inventors: Benoit Jean Henri Berthelet, Maisons Alfort (FR); Gérard Michel Roland Gueldry, Vert St Denis (FR); Claude Marcel Mons, Savigny le Temple (FR); Marie-Christine Ntsama-Etoundi, Charenton (FR)

(73) Assignee: SNECMA Moteurs, Paris (FR)

( * ) Notice: Subject to any disclaimer, the term of this patent is extended or adjusted under 35 U.S.C. 154(b) by 0 days.

(21) Appl. No.: 10/129,750

(22) PCT Filed: Sep. 20, 2001

(86) PCT No.: PCT/FR01/02917

§ 371 (c)(1),
(2), (4) Date: Jan. 10, 2003

(87) PCT Pub. No.: WO02/24411

PCT Pub. Date: Mar. 28, 2002

(65) Prior Publication Data

US 2003/0115922 A1 Jun. 26, 2003

(30) Foreign Application Priority Data

Sep. 21, 2000 (FR) ..... 00 12017

(51) Int. Cl.[7] ..... B24B 1/00; C21D 7/06; B21J 10/00

(52) U.S. Cl. ..... 72/53; 451/39; 451/40

(58) Field of Search ..... 72/53; 451/39, 451/40

(56) References Cited

U.S. PATENT DOCUMENTS

| | | | | | |
|---|---|---|---|---|---|
| 3,438,229 | A | * | 4/1969 | Bartlett | 72/53 |
| 3,482,423 | A | * | 12/1969 | Smith et al. | 72/53 |
| 3,668,913 | A | * | 6/1972 | Morris | 72/53 |
| 4,426,867 | A | | 1/1984 | Neal et al. | |
| 5,733,392 | A | * | 3/1998 | Usher | 72/53 |
| 5,950,469 | A | * | 9/1999 | Tsuro et al. | 72/53 |
| 6,289,705 | B1 | * | 9/2001 | Duquenne et al. | 72/53 |
| 6,336,844 | B1 | * | 1/2002 | Duquenne et al. | 451/36 |

FOREIGN PATENT DOCUMENTS

| | | |
|---|---|---|
| EP | 1 101 568 | 5/2001 |
| FR | 2 714 629 | 7/1995 |
| FR | 2 801 236 | 5/2001 |

* cited by examiner

*Primary Examiner*—David Jones
(74) *Attorney, Agent, or Firm*—Oblon, Spivak, McClelland, Maier & Neustadt, P.C.

(57) ABSTRACT

The invention concerns a method for transverse ultrasound peening of blades (2) on a rotor which consists in driving in rotation the wheel (3) bearing the blades (2) about its geometrical axis (6) arranged substantially vertically and in causing the blades (2) to pass through a mist of microbeads produced by a vibrating surface (20) in an active chamber (12) arranged laterally relative to the wheel. The active surface (20) is located beneath the path of the blades (2). Preferably, the active chamber (12) comprises a second vibrating surface above the path of the blades (2). The invention also concerns a machine for implementing said method.

30 Claims, 3 Drawing Sheets

FIG.2
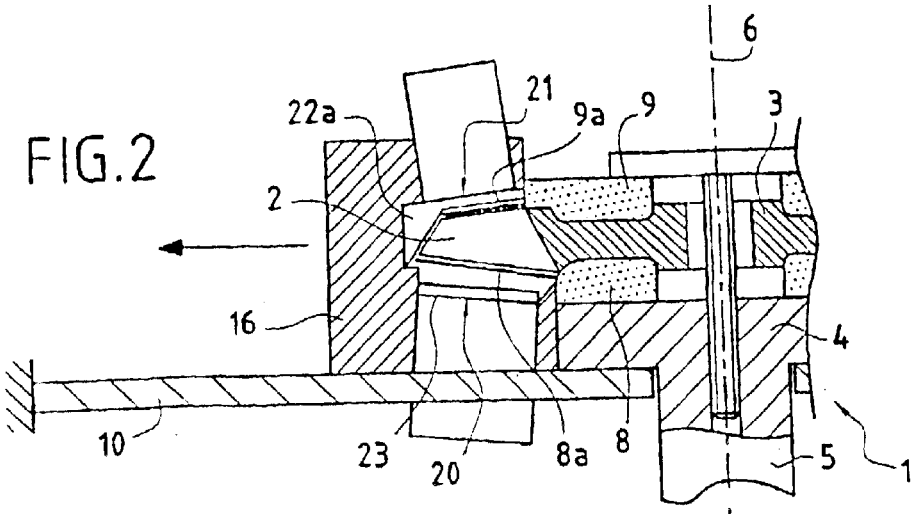
FIG.3
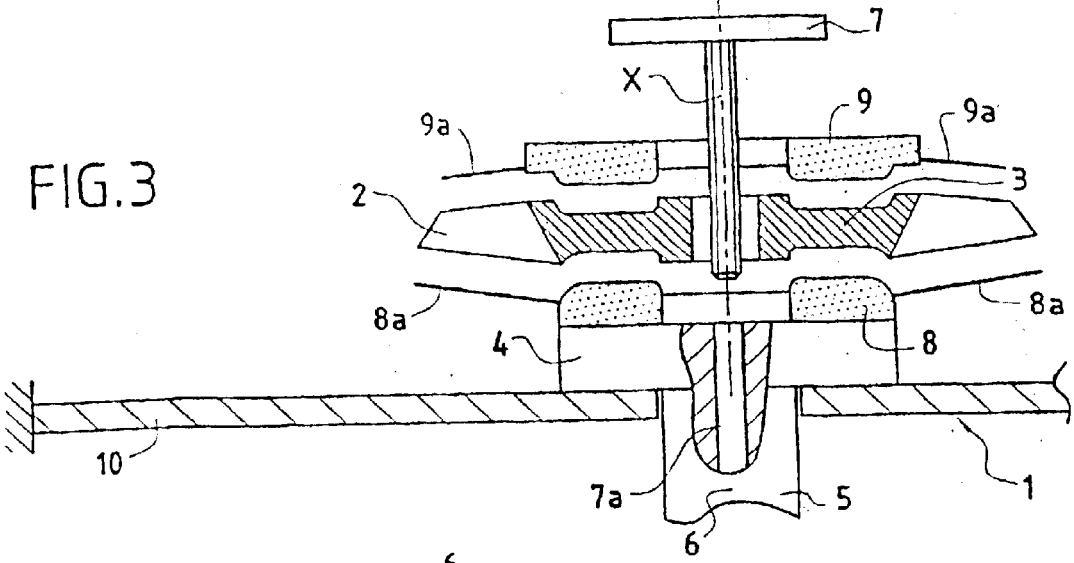
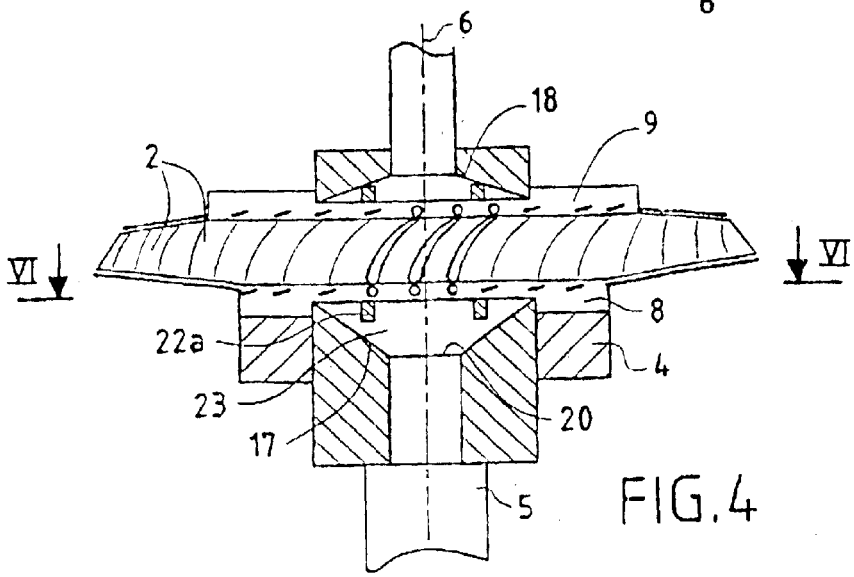
FIG.4

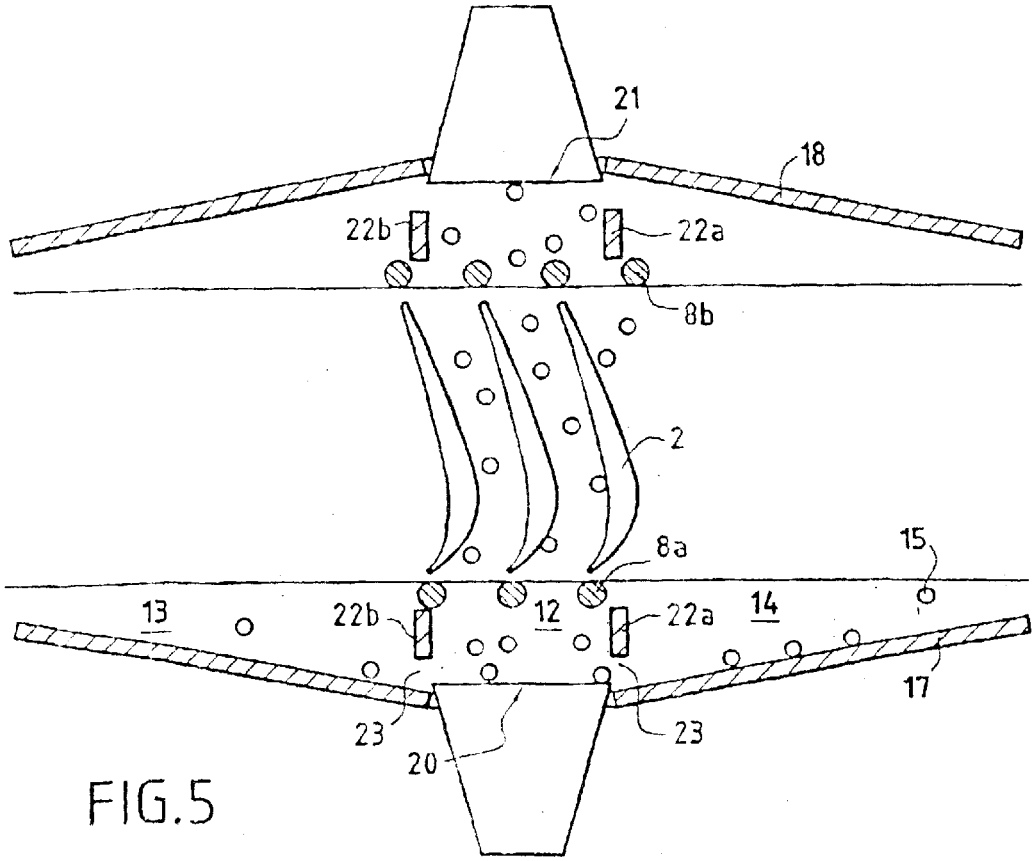
FIG.5
FIG.6
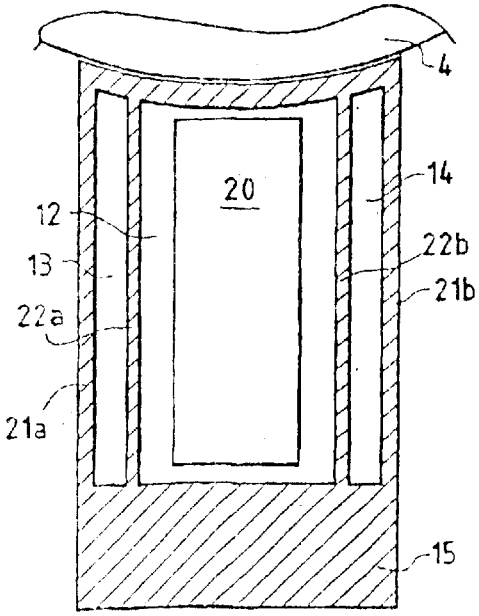
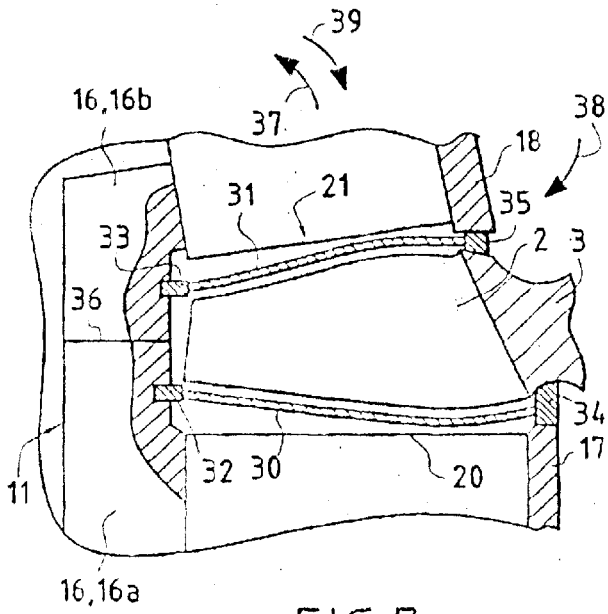
FIG.7

TRANSVERSE ULTRASOUND PEENING OF BLADES ON A ROTOR

The invention relates to a method for the ultrasonic peening of parts which lie radially at the periphery of a wheel, such as the aerofoil sections of turbomachine blades on a rotor. The invention also relates to a peening machine for implementing the method.

The term "wheel" is to be understood as meaning an object the overall shape of which exhibits symmetry of revolution about a geometric axis and which can be rotated about its axis.

In order to improve the fatigue strength of mechanical parts, it is known practice for their surface to be peened using microbeads. This technique is very widely used in the aeronautical industry to place the surface of parts under permanent compression to a shallow depth. This introduction of compression opposes the onset or growth of cracks at the surface of the part, and this makes it possible to improve the fatigue strength. The technique consists in propelling microbeads against the surface of the part at an angle of incidence which is small with respect to the normal to this surface and with sufficient kinetic energy.

As a preference, the angle of incidence is below 45° with respect to the normal to the surface so that the impact can transmit sufficient energy from the bead to the impacted surface. Exposure of the part to peening passes through an optimum. Insufficient peening does not yield the anticipated strength but additional peening can still be performed. On the other hand, excessive peening causes irreversible damage to the part.

The shot peening technique is applied in particular for compressing the surfaces of the aerofoil sections of the blades of a turbomachine rotor. In the case of fine-walled blades, it is necessary to peen both sides of the aerofoil sections at the same time, so as to avoid deformation through modification of the curvatures in the thin regions.

Traditionally, thick-walled surfaces are peened by propelling the microbeads using a nozzle fed simultaneously with compressed gas and with microbeads. The aerofoil sections of turbomachine blades are peened by means of two nozzles each peening one side of the aerofoil section. This method of peening in itself has two drawbacks:

- the peening parameters are not stable, and the peening machine has frequently to be checked and adjusted when seeking close to optimum peening,
- the surface finish is damaged, which detracts from the life of the parts,
- the method has to be carried out in a cabin which is large enough to allow the parts and the peening nozzles to be manipulated.

When the surfaces for peening are the aerofoil sections of one-piece bladed wheels, separated by relatively small distances, the peening method using nozzles is even more tricky to implement.

In the French patent application filed on Nov. 18, 1999 and recorded under the number FR 99 14 482, the applicant company proposed a method of ultrasonic peening using a mist of microbeads sustained in an active chamber by a vibrating surface. According to the method described in that application, the wheel is rotated about its axis which is arranged horizontally. The blades situated in the lower part of the wheel pass through the active chamber at low speed and are impacted by the microbeads of the mist sustained by the vibrating surface arranged under the ends of the lower blades.

The microbeads activated by the vibrating surface strike the surfaces of the blades which are situated in the active chamber, off which they rebound, and the peripheral walls of the wheel which lie between the blades. The microbeads which have lost their kinetic energy drop down onto the vibrating surface which propels them back into the active chamber. Some microbeads leave the active chamber and are collected in adjacent inactive chambers from where they return to the bottom of the active chamber under gravity.

The thin ends of the aerofoil sections are subjected to very violent impacts and have to be trimmed at the end of the peening operation.

During the peening operation, the wheel rotates through several revolutions. It is thus easier to reach the optimum and avoid asymmetries in peening, which asymmetries give rise to deformation when the parts are thin.

The method described in FR 99 14 482 is particularly suited to the aerofoil sections of blades of relatively short length.

However, when the aerofoil sections are long by comparison with the distance between two consecutive aerofoil sections, particularly if the ratio between the length and the interblade distance is greater than three, or alternatively when the height of the aerofoil section is greater than 100 mm and the aerofoil section has a very curved shape, the flanks of the aerofoil sections situated toward the bottom of the interblade space are not peened as much because the microbeads have already rebounded several times in order to reach them and have lost some of their kinetic energy. Thus, peening is not homogeneous and the duration of the peening has to be increased in order to make sure that all points undergo a minimum amount of peening.

The object of the invention is to propose a method for the ultrasonic peening of parts which lie radially at the periphery of a wheel and which allows the surfaces of these parts to be peened effectively irrespective of their length.

The invention therefore relates to a method for the ultrasonic peening of parts lying radially at the periphery of a wheel, according to which method the wheel is set in rotation about its geometric axis and a mist of microbeads is created in a fixed active chamber arranged to the side of said wheel, by means of a first vibrating surface arranged in the lower part of said active chamber comprising openings shaped to allow the parts to be put in and removed as the wheel rotates and being sized to accommodate at least three adjacent parts.

The method according to the invention is characterized in that the wheel is rotated about its axis, which is arranged roughly vertically, and in that the first vibrating surface is arranged under the path of the parts in the active chamber.

This arrangement allows all the surface regions of the parts passing through the active chamber to be impacted irrespective of their distance from the axis of rotation of the wheel.

According to an advantageous feature of the method according to the invention, the chamber comprises a second vibrating surface above the path of the parts in the active chamber.

By virtue of this feature, the microbeads which reach the upper part of the chamber with low kinetic energy and are ready to drop down under gravity, are reactivated by this second vibrating surface, and once again participate in the actual peening operation by rebounding off the surfaces of the parts and the walls of the active chamber.

When the method according to the invention is applied to parts having thin edges facing a vibrating surface, such as the leading edges and trailing edges of the aerofoil sections of turbomachine blades, and according to another advantageous feature of the invention, said thin edges are protected during peening.

This protection may preferably be afforded by rods which rotate as one with the wheel and each conceal a thin edge. These rods are arranged between the thin edges and the sonotrodes. They have the effect of reducing the energy of the beads likely to impact the thin edges. They may be in contact with the thin edges or may be a small distance away therefrom.

It may also be afforded by fixed rods secured to the chamber. In this case, the wheel is rotated step by step during peening so that the edges of the parts lying in the active chamber face the fixed rods. Peening may be halted while the wheel is being pivoted by one step.

Thus, during peening, the rods lie between the thin edges of the blades and the sonotrodes so as to protect the thin edges from high-energy impacts from balls coming directly from a sonotrode.

The invention also relates to a peening machine for implementing the abovementioned method.

This machine is characterized in that it comprises:

a turntable of roughly vertical axis equipped with means for holding a wheel radially comprising parts for peening, coaxially with respect to said turntable, means for rotating the turntable about its axis, and at least one device for peening said parts, said peening device comprising:

an active chamber arranged to the side of said wheel and sized to house at least three adjacent parts and having an opening shaped to allow the parts to be put in and removed as the region rotates, a first vibrating surface arranged in the bottom of the active chamber under the path of the parts in said active chamber and able to sustain a mist of microbeads in said active chamber, and means for collecting the microbeads which escape from the active chamber and returning them to said chamber.

Advantageously, the peening device further comprises a second vibrating surface arranged in the active chamber above the path of the parts.

The machine may also comprise means for protecting the edges of the parts situated facing a vibrating surface.

Other advantages and features of the invention will become apparent from reading the following description given by way of example and with reference to the appended drawings in which:

FIG. 2 is a vertical section on FIGS. II—II of FIG. 1;

FIG. 3 shows the fixing of the bladed wheel to the turntable of the machine and the arrangement of the arrays of gratings for protecting the leading edges and trailing edges of the aerofoil sections;

FIG. 4 is a section of the peening machine on a vertical plane intersecting the plane of FIG. 1, on the line IV—IV;

FIG. 5 is similar to FIG. 4 and shows, on a larger scale, the active chamber and the chambers for collecting the microbeads that leave the active chamber;

FIG. 6 is a section on the line VI—VI of FIG. 4, in a horizontal plane passing through the chambers and situated under the path of the blades in the peening device; and FIG. 7 is similar to FIG. 2 and shows, on a larger scale, the peening device and the rods protecting the leading edges and trailing edges of the aerofoil sections, these rods being fixably mounted on the chambers.

Figure 1:
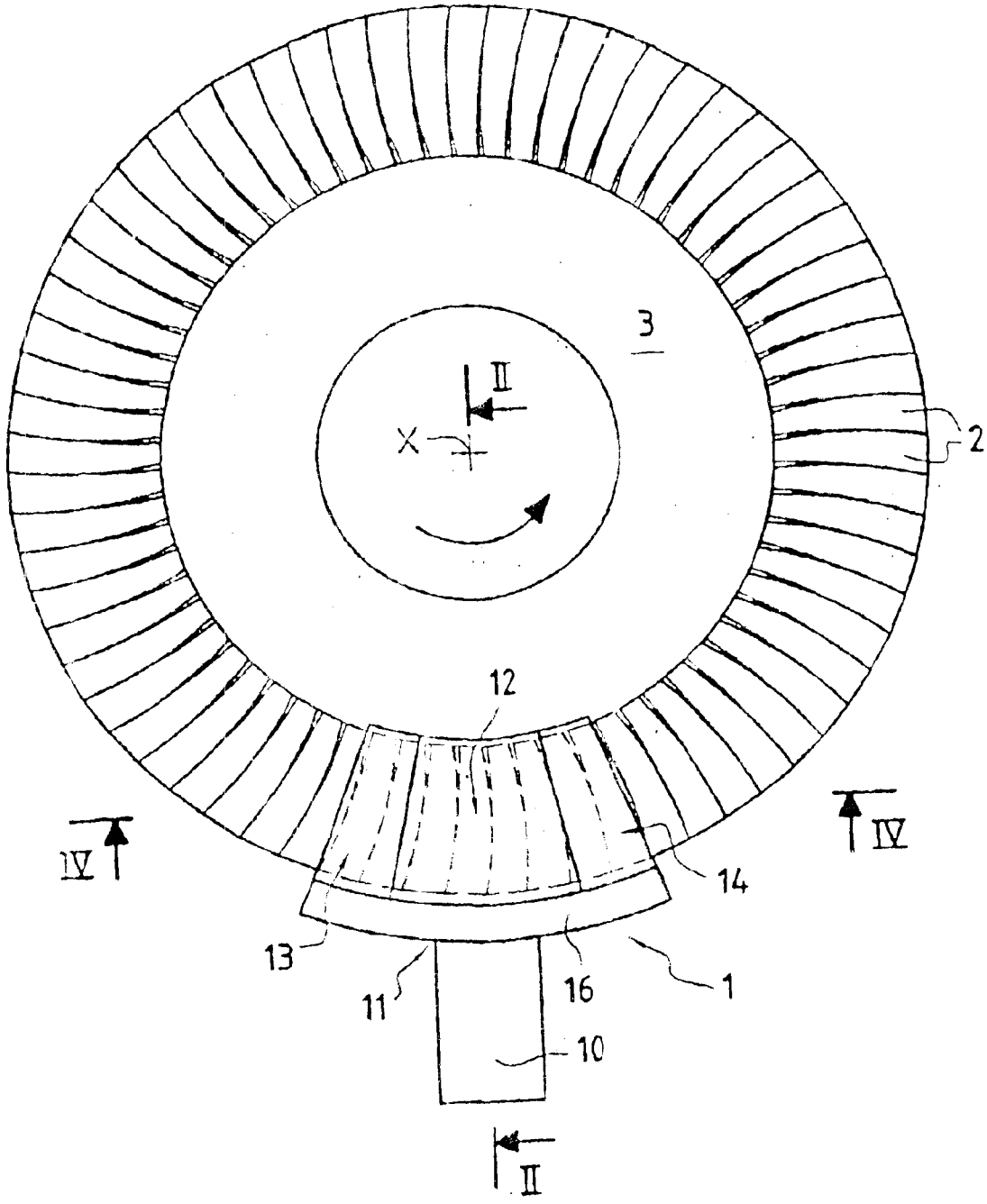
FIG. 1 is a schematic view from above of a peening machine according to the invention on which is mounted a bladed turbomachine wheel the aerofoil sections of the blades of which need to be peened.

In the drawings, the reference 1 denotes a machine for peening the aerofoil sections 2 which lie radially at the periphery of a wheel 3 of axis x of a turbomachine. The wheel 3 may, for example, be a one-piece bladed disk (blisk) or a turbomachine wheel equipped with moving blades. The aerofoil sections 2 may also be parts the surfaces of which need to be peened and which comprise means for holding them radially and uniformly angularly spaced at the periphery of a wheel 3 which then acts as a support for the parts that are to be peened.

The peening machine 1 essentially comprises a turntable 4 carried by a shaft 5 of roughly vertical axis 6. The shaft 5 can be rotated about its axis 6 by rotational-drive means, for example an electric motor, not shown in the drawings. The wheel 3 is fixed to the turntable 4 by means of a clamping piece 7 collaborating with a tapped bore 7*a* of axis 6 formed in the turntable 4 so that its axis x coincides with the axis 6 of the turntable 4.

As a preference, as can be seen in FIGS. 2 and 3, a first annular flange 8 is inserted between the turntable 4 and the wheel 3, and a second annular flange 9 is inserted between the wheel and the clamping piece 7.

These annular flanges 8 and 9 comprise, at their periphery, radial rods 8*a* and 9*a* respectively, equal in number to the number of aerofoil sections 2 on the wheel 3, uniformly spaced about the axis x. Each rod 8*a* and 9*a* adopts the shape of the trailing edges and leading edges of the aerofoil sections 2. The low annular flange 8 is positioned under the wheel 3 in such a way that the array of radial rods 8*a* covers the lower edges of the aerofoil sections 2. The upper annular flange 9 is also positioned angularly with respect to the wheel 3 in such a way that the array of rods 9*a* covers the upper edges of the aerofoil sections 2. As the turntable 4 rotates about the axis 6, the wheel 3 and the annular flanges 8 and 9 rotate about the axis 6.

The diameter of the turntable 4 is chosen to suit the wheel 3 and such that the aerofoil sections 2 project radially from the periphery of said turntable.

In FIGS. 1 to 3 it can be seen that the machine 1 also comprises a fixed, roughly horizontal slideway 10, secured to the structure supporting the shaft 5, and the axis of which is perpendicular to the axis 6 of the shaft 5.

Mounted to slide on the slideway 10 is the actual peening device 11 proper. When the wheel 3 is mounted on the turntable 4 or removed therefrom, the peening device 11 is moved away from the turntable 4.

This peening device 11 essentially comprises a central chamber 12 known as an active chamber arranged between two side chambers 13 and 14 known as inactive chambers and intended to collect microbeads 15 which might escape from the central chamber and to return them to the central chamber 12 as explained later on in this text.

The chambers 12 and 13 and 14 are delimited together by a rigid external peripheral wall 16 in the form of a circular sector and the inside diameter of which is roughly equal to or slightly greater than the diameter of the path followed by the tips of the aerofoil sections 2 as the wheel 3 rotates about the axis 6, a dished lower wall 17 which runs between the peripheral wall 16 and the periphery of the turntable 4 and an upper wall 18 in the shape of an inverted dish or of a dome which runs between the peripheral wall 16 and the periphery of the upper flange 9.

The lower wall 17 is arranged under the path followed by the aerofoil sections 2 as the wheel 3 rotates and the upper wall 18 is situated above this path. A lower vibrating surface 20 is arranged in the bottom of the dish formed by the lower wall 17 and a second vibrating surface 21 is arranged in the upper part of the dome formed by the upper wall 18.

Vertical and radial partitions with openings the outline of which is shaped according to the annular surfaces generated by the rods 8*a* and 9*a* as the wheel 3 rotates, connect the walls 17 and 18 to the peripheral wall 16. These partitions, of which there are four above and below the path of the aerofoil sections 2 comprise, in particular, lateral end partitions 21*a*, 21*b* which circumferentially delimit the inactive chambers 13 and 14, and intermediate partitions 22*a*, 22*b* which separate the active chamber 12 from the inactive side chambers 13 and 14. The lower intermediate partitions 22*a*, 22*b* have, near the lower wall 17, openings or slots 23 which allow the microbeads 15 which enter the inactive side chambers 13 and 14 to return to the lower vibrating surface 20 under gravity.

The active chamber 12 is thus circumferentially delimited by the partitions 22*a* and 22*b* and is arranged between the vibrating surfaces 20 and 21 as visible in FIG. 5.

The circumferential size of this active chamber 12 is such that at least three aerofoil sections 2 can be housed in this active chamber 12.

A certain amount of microbeads 15 is placed in the active chamber 12. When the vibrating surfaces 20 and 21 of the sonotrodes are activated, the microbeads 15 placed above the lower vibrating surface 20 are propelled upward, strike the surfaces of the aerofoil sections 2, rebound off these surfaces and continue on their way randomly. Some of these microbeads 15 reach the upper vibrating surface 21 which gives them further kinetic energy. These beads 15 once again strike the walls of the blades 2 as they descend. It goes without saying that some microbeads 15 strike the intermediate partitions 22*a* and 22*b* off which they rebound. These microbeads 15 remain in the active chamber 12 and drop back onto the vibrating surface 20 when they have lost their kinetic energy.

Because of the movement of the aerofoil sections 2 through the openings formed between the upper and lower intermediate partitions 22*a* and 22*b*, some microbeads 15 enter the side chambers 13 and 14 via the space separating the contours of the partitions 22*a* and 22*b* from the closest rods 8*a* and 9*b*. These microbeads 15 quickly lose their kinetic energy in the side chambers 13 and 14, drop onto the bottom wall 17 which is inclined, and return to the lower vibrating surface 20 via the slots 23 formed at the foot of the lower intermediate partitions 22*a* and 22*b*.

As the wheel 3 rotates through one revolution, the aerofoil sections 2 are impacted by the microbeads 15 for the time that they are resident in the active chamber 12.

Advantageously, this residence time is markedly shorter than the total peening time needed to obtain the optimum result, and the number of revolutions to be performed in order to obtain the optimum result is calculated accordingly. This number of revolutions is at least equal to 3. This makes it possible to reduce the deformation of the aerofoil sections as a result of the temporary differences in peening between the two faces of the aerofoil sections during treatment. What happens is that when an aerofoil section enters the chamber, its face facing in the direction of rotation experiences more intense peening than its opposite face, because it is more exposed to the high-energy impacts of the beads coming directly from the sonotrode. The compressive preloading of the forward-facing face is therefore greater than that of the opposite face, which causes partially plastic deformation toward the rear of the aerofoil section. When the aerofoil section is leaving the peening chamber, it is the opposite phenomenon which occurs, but residual aerofoil-section deformation nonetheless remains.

By carrying out the peening over N revolutions instead of just one, the temporary difference in peening between the two faces of the aerofoil sections is divided by N, which divides the resultant deformation of the aerofoil sections more or less by N. The number N of revolutions is not critical. Three to five revolutions is considered by the applicant as being acceptable for obtaining a significant result.

It should be noted that in order to reduce the total peening time it is possible to equip the machine 1 with several peening devices 11 identical to the one described hereinabove and which are distributed angularly about the axis 6.

FIG. 7 shows an alternative form of embodiment of the system for protecting the leading edges and trailing edges of the aerofoil sections 2. In this alternative form, the annular flanges 8 and 9 do not comprise any arrays of radial rods 8*a*, 9*a*. The protective rods 30 and 31, which are fixed with respect to the peening device 11, are mounted in the active chamber 12. The number of rods 30 and 31 is equal to the number of aerofoil sections 2 that can be housed in the active chamber 12.

During the peening operation, the aerofoil sections 2 are immobilized for a certain length of time in a position such that their leading edges and their trailing edges are protected by the rods 30 and 31. They are then moved through a step equal to the angular spacing between two consecutive aerofoil sections 2.

In a preferred embodiment of the invention, the rods 30, 31 are fixed, at one end 32, 33, to the outer wall 16 and, at the other end, to a common support 34, 35 which acts as a seal between the rotor 3 and, respectively, the interior walls 17, 18, this seal being afforded when the clearances left are smaller than the diameter of the beads.

To make it easier to get the rotor 3 into the peening chambers 12, 13 and 14, it may be advantageous for the outer wall 16 to be split into two parts 16*a* and 16*b* separated by a parting line 36 more or less in the plane of the rotor 3. The rotor is then introduced using the following procedure:

moving apart, along the path 37, the upper constituents of the chambers, namely the upper part 16*a* of the outer wall 16, the sonotrode 21 and the internal wall 18, introducing the rotor 3 along the path 38, bringing back together these same upper constituents of the chambers along a path 39 that is the opposite of the path 37, so as to close the chambers again around the rotor and allow peening to take place.

This step by step movement is performed at high speed if peening continues during this movement, so that the leading edges and the trailing edges are impacted infrequently during the movement. It is also possible to shut down the sonotrodes for the time that the aerofoil sections 2 are being moved stepwise.

What is claimed is:

1. A method for ultrasonic peening of parts lying radially at a periphery of a wheel, comprising:

setting the wheel in rotation about its geometric axis; creating a mist of microbeads in a fixed active chamber arranged to a side of said wheel, by a first vibrating surface arranged in a lower part of said active chamber, said active chamber comprising an opening shaped to allow the parts to be put in and removed as the wheel rotates and being sized to accommodate at least three adjacent parts;

wherein the wheel is rotated about said geometric axis which is substantially vertical, and the first vibrating surface is arranged under a path of the parts in the active chamber.

2. The method as claimed in claim 1, wherein the active chamber comprises a second vibrating surface above the path of the parts in the active chamber.

3. The method as claimed in claim 1, wherein said parts have thin edges facing the vibrating surface, wherein said thin edges are protected during peening.

4. The method as claimed in claim 3, wherein the thin edges of the parts are protected using rods that rotate as one with the wheel.

5. The method as claimed in claim 3, wherein the thin edges of the parts situated in the active chamber are protected using rods secured to an outer wall of the chamber and the wheel is rotated by a step equal to an angular spacing between two adjacent parts so that said thin edges are protected by said rods before and after said step and during peening.

6. The method as claimed in claim 1, wherein the wheel performs at least three revolutions during peening.

7. A peening machine for peening parts lying radially at a periphery of a wheel, said machine comprising:

a turntable having an axis which is substantially vertical and equipped with means for holding said wheel coaxially with respect to said turntable;

means for rotating the turntable about its axis, and at least one device for peening said parts, said peening device comprising:

an active chamber arranged to a side of said wheel and sized to house at least three adjacent parts and having an opening shaped to allow the parts to he put in and removed as the wheel rotates;

a first vibrating surface arranged in a bottom of the active chamber under a path of the parts in said active chamber and configured to sustain a mist of microbeads in said active chamber; and means for collecting microbeads that escape from the active chamber and returning collected microbeads to said chamber.

8. The machine as claimed in claim 7, wherein the peening device further comprises a second vibrating surface arranged in the active chamber above the path of the parts.

9. The machine as claimed in claim 7, further comprising means for protecting edges of the parts, said means for protecting being situated facing the first vibrating surface.

10. The machine as claimed in claim 9, wherein the protecting means comprises an array of radial rods that rotate with the wheel.

11. The machine as claimed in claim 9, wherein the protecting means comprises rods secured to an outer wall of the active chamber.

12. The machine as claimed in claim 7, wherein said peening device is configured to move in a direction substantially perpendicular to the axis of the turntable.

13. A peening machine comprising:

a turntable rotatable within a plane and around an axis;

a part support coupled to said turntable and capable of rotating with said turntable;

a chamber configured to house at least a portion of said part support and having an opening configured so that said portion of said part support can pass through said opening;

a first vibrating surface positioned in said chamber, said first vibrating surface being configured to propel microbeads toward said portion of said part support and in a first direction substantially perpendicular to said plane in which said turntable is rotatable.

14. The peening machine of claim 13, wherein said axis is substantially vertical.

15. The peening machine of claim 13, wherein said first vibrating surface is positioned under said portion of said part support.

16. The peening machine of claim 13, wherein said first vibrating surface is configured to propel microbeads upwards toward said portion of said part support.

17. The peening machine of claim 13, wherein said part support is a wheel.

18. The peening machine of claim 13, further comprising parts mounted on a periphery of said part support, and wherein said portion of said part support includes a portion of periphery.

19. The peening machine of claim 18, wherein said opening is sized so that said parts can pass through said opening.

20. The peening machine of claim 18, wherein said chamber is sized to house at least three of said parts.

21. The peening machine of claim 13, wherein said first vibrating surface is positioned in a bottom of said chamber.

22. The peening machine of claim 13, wherein said first vibrating surface is configured to sustain a mist of said microbeads in said chamber.

23. The peening machine of claim 13, further comprising walls and partitions configured to collect microbeads that escape from the chamber and return collected microbeads to said chamber.

24. The peening machine of claim 13, further comprising a second vibrating surface positioned in said chamber, said second vibrating surface being configured to propel microbeads toward said portion of said part support and in a second direction opposite to said first direction and substantially perpendicular to said plane in which said turntable is rotatable.

25. The peening machine of claim 24, wherein said second vibrating surface is positioned above said portion of said part support.

26. The peening machine of claim 24, wherein said second vibrating surface is configured to propel microbeads downwards toward said portion of said part support.

27. The peening machine of claim 13, further comprising protectors positioned in said chamber between said portion of said part support and said first vibrating surface.

28. The peening machine of claim 27, wherein said protectors are coupled to said turntable and configured to rotate with said part support.

29. The peening machine of claim 27, wherein said protectors are attached to an outer wall of said chamber.

30. The peening machine of claim 27, wherein said protectors are rods.

* * * * *

UNITED STATES PATENT AND TRADEMARK OFFICE

CERTIFICATE OF CORRECTION

PATENT NO. : 6,837,085 B2
DATED : January 4, 2005
INVENTOR(S) : Benoit J. Berthelet et al.

It is certified that error appears in the above-identified patent and that said Letters Patent is hereby corrected as shown below:

Title page,
Item [57], ABSTRACT, replace with:
-- A method, and machine for implementing the method, for transverse ultrasound peening of blades on a rotor that drives in rotation a wheel bearing the blades about its geometrical axis arranged substantially vertically and causes the blades to pass through a mist of microbeads produced by a vibrating surface in an active chamber arranged laterally relative to the wheel. The active surface is located beneath the path of the blades. Preferably, the active chamber includes a second vibrating surface above the path of the blades. --.

Signed and Sealed this

Twenty-ninth Day of November, 2005

JON W. DUDAS
*Director of the United States Patent and Trademark Office*